US006708534B1

(12) United States Patent
Ruan

(10) Patent No.: US 6,708,534 B1
(45) Date of Patent: Mar. 23, 2004

(54) PADLOCK

(75) Inventor: Jiaqiang Ruan, Taishan (CN)

(73) Assignees: Wah Yuet (NG'S) Co., Ltd., Hong Kong (CH); Master Lock Company, Milwaukee, WI (US)

( * ) Notice: Subject to any disclaimer, the term of this patent is extended or adjusted under 35 U.S.C. 154(b) by 0 days.

(21) Appl. No.: 10/316,580

(22) Filed: Dec. 11, 2002

(51) Int. Cl.[7] ..... E05B 37/06; E05B 37/00

(52) U.S. Cl. ..... 70/38 A; 70/284; 70/21; 70/28

(58) Field of Search ..... 70/21, 24–28, 70/38 R, 41, 42, 284, 38 A, 285, 48

(56) References Cited

U.S. PATENT DOCUMENTS 1,660,903 A * 2/1928 Adamson ..... 70/38 A
1,755,521 A * 4/1930 Smith ..... 70/21
2,853,868 A * 9/1958 Vahlstrom ..... 70/24
3,750,431 A * 8/1973 Atkinson ..... 70/21
4,325,240 A * 4/1982 Gable ..... 70/284
5,005,384 A * 4/1991 Lo et al. ..... 70/25
5,953,940 A * 9/1999 Ling ..... 70/25
6,012,309 A * 1/2000 Liu ..... 70/25
6,539,761 B2 * 4/2003 Yang ..... 70/284

* cited by examiner

*Primary Examiner*—John B. Walsh
(74) *Attorney, Agent, or Firm*—McAndrews, Held & Malloy, Ltd

(57) ABSTRACT

The present invention provides a padlock that comprises a shackle, a lock body, a lock cylinder assembly disposed at the middle portion in the lock body, and a combination lock assembly. The padlock of the invention can be operated by either the key or the cipher. The invention also provides a padlock having an interchangeable lock cylinder assembly.

20 Claims, 5 Drawing Sheets

A—A

B—B

PADLOCK

FILED OF THE INVENTION

The present invention relates to a padlock, particularly to a padlock that can be operated by either the key or the cipher, and has an interchangeable lock cylinder.

BACKGROUND OF THE INVENTION

The padlock is the commonest lock used in the life. The padlock in the prior art may be generally unlocked with the key or the cipher. The latter is commonly called a combination lock. The traditional key-operated lock usually comprises a housing, a shackle, a lock body, a lock cylinder disposed in the lock body, slide pins arranged on the lock cylinder and lock body, a spring bolt disposed within the lock body. A key is used to drive the lock cylinder and hereby acts on the spring bolt to open the lock. The conventional combination lock comprises a housing, shackle, a lock body, a code mechanism including numeral wheels disposed in the lock body, a spring bolt acted on by the code mechanism. The combination lock can be unlocked when the numeral wheels are turned to a predetermined sequence. The problem of the key-operated lock is that people often lose the key, and that of the combination lock is that the users tend to forget the predetermined code. Therefore, it is desirable to create a lock that can be operated by either the key or the cipher. However, such a lock has not been disclosed in the art.

SUMMARY OF THE INVENTION

Therefore, the present invention is to provide a new padlock that can be operated either by the key or by the cipher.

The padlock according to the present invention comprises a shackle having a long leg, a short leg, and two bolt recesses respectively disposed at the long leg and the short leg; a housing having two shackle holes to allow the shackle passing therethrough; a lock body having a first sidewall, a second sidewall, and a first shackle groove for receiving the long leg of the lock shackle, and a second shackle groove for receiving the short leg of the lock shackle; a lock bolt mechanism disposed at the upper portion in the lock body, including a spring and two blocks connected to the two ends of the spring; a lock cylinder assembly disposed at the middle portion in the lock body, comprising a cylinder housing, a lock cylinder disposed through the cylinder housing, a key receiving recess extended axially and inwardly for receiving a first key, and a drive pin connected to the portion of the lock cylinder out of the cylinder housing; and a combination lock assembly.

The combination lock assembly comprises a fork mechanism having a fork lever and a plurality of plates parallel to the fork lever, fastened to the second sidewall by a fastening spring; a wheel mechanism comprising a plurality of numeral wheels, each numeral wheel being disposed between two adjacent plates; and a clutch mechanism disposed within the wheel mechanism, including a clutch shaft and a plurality of rotatable clutch sleeves disposed on the clutch shaft, each clutch sleeve including a disc perpendicular to the clutch shaft. Each disc has a plane at the rim in matching with the plate.

When the padlock is locked, the two blocks of the lock bolt mechanism are engaged with the bolt recesses of the shackle and the fork lever is positioned between the two blocks.

When the first key inserted into the key receiving recess is turned, the drive pin drives the fork lever to move outwards so that the two blocks move to the center of the spring by pressing the shackle downwards to unlock the padlock.

When the numeral wheels are turned to a predetermined sequence, all the planes of the discs are positioned at the same plane and contact the plates of the fork mechanism, the fork lever moves outwards by the action of the drive spring so that the two blocks can move to the center of the spring by pressing the shackle downwards to unlock the padlock.

In an embodiment of the lock body of the invention, the lock body defines two protrusions extended longitudinally for matching two recesses by the fork mechanism at its outside correspondingly, so that the fork mechanism can rotate round the protrusions to ensure the fork lever to move outwards.

In the present invention, the padlock may include a means for resetting a new cipher. The means comprises a second key that can drive the clutch shaft moving backwards so that the new cipher can be reset by turning the numeral wheels.

In an embodiment of the combination lock assembly, it may further comprise a reed mechanism. The reed mechanism includes a connecting member fastened to the second sidewall and a plurality of reeds perpendicular to the connecting member. Each reed contacts the upper rim of a numeral wheel so that the numeral wheel can only turn one number once.

In one preferred embodiment of the present invention, the lock body defines a screw hole extended obliquely and downwards from the second shackle groove to engage with a connecting groove positioned at the surface of the cylinder housing. A connecting screw is inserted into the screw hole and the connecting groove to fix the lock cylinder assembly to the lock body.

The padlock of the present invention may further comprise a bottom cover to match the housing of the padlock. In this case the outer rim of the numeral wheel exceeds the bottom cover.

DETAILED DESCRIPTION OF THE INVENTION

The invention will be further described in detail in conjunction with the drawings.

Figure 1:
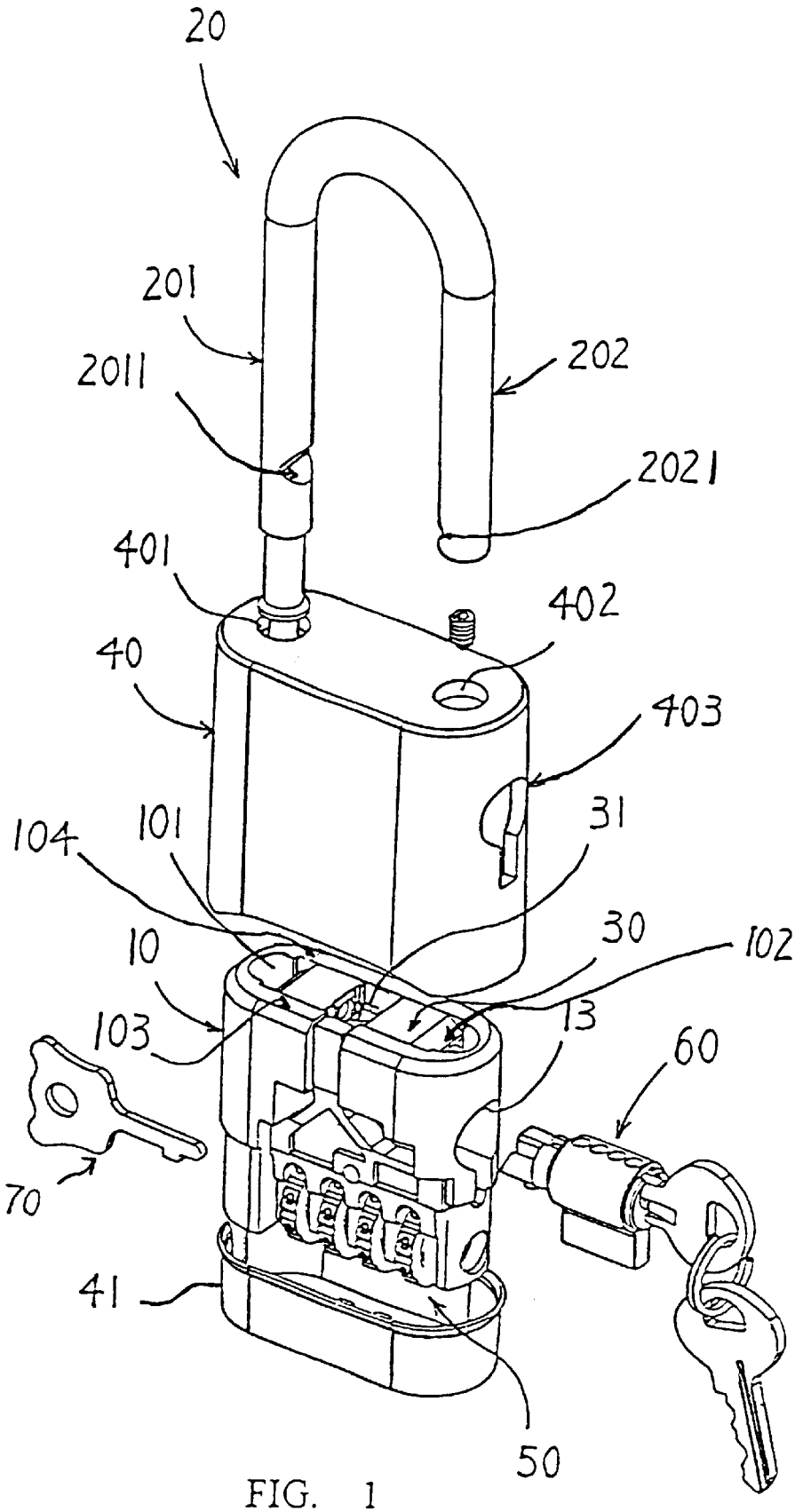
FIG. 1 is a partially exploded view of an embodiment of the padlock of the invention.

As shown in FIG. 1, an embodiment of the padlock of the invention includes a shackle 20, a housing 40, a lock body 10, a lock bolt mechanism 30 disposed at the upper portion of the body 10, a lock cylinder assembly 60 mounted to the body, and a combination lock assembly 50. In this embodiment, the padlock further comprises a bottom cover 41.

The shackle 20 has a long leg 201 and a short leg 202. Two recesses 2011 and 2021 are respectively disposed at the long leg 201 and the short leg 202. The housing 40 provides two shackle holes 401 and 402 to allow the shackle passing therethrough.

The lock body 10 comprises a first sidewall 104 and a second sidewall 104. Corresponding to the shackle holes 401 and 402, the lock body also provides a first shackle groove 101 for receiving the long leg 201, and a second shackle groove 102 for receiving the short leg 202.

Figure 2:
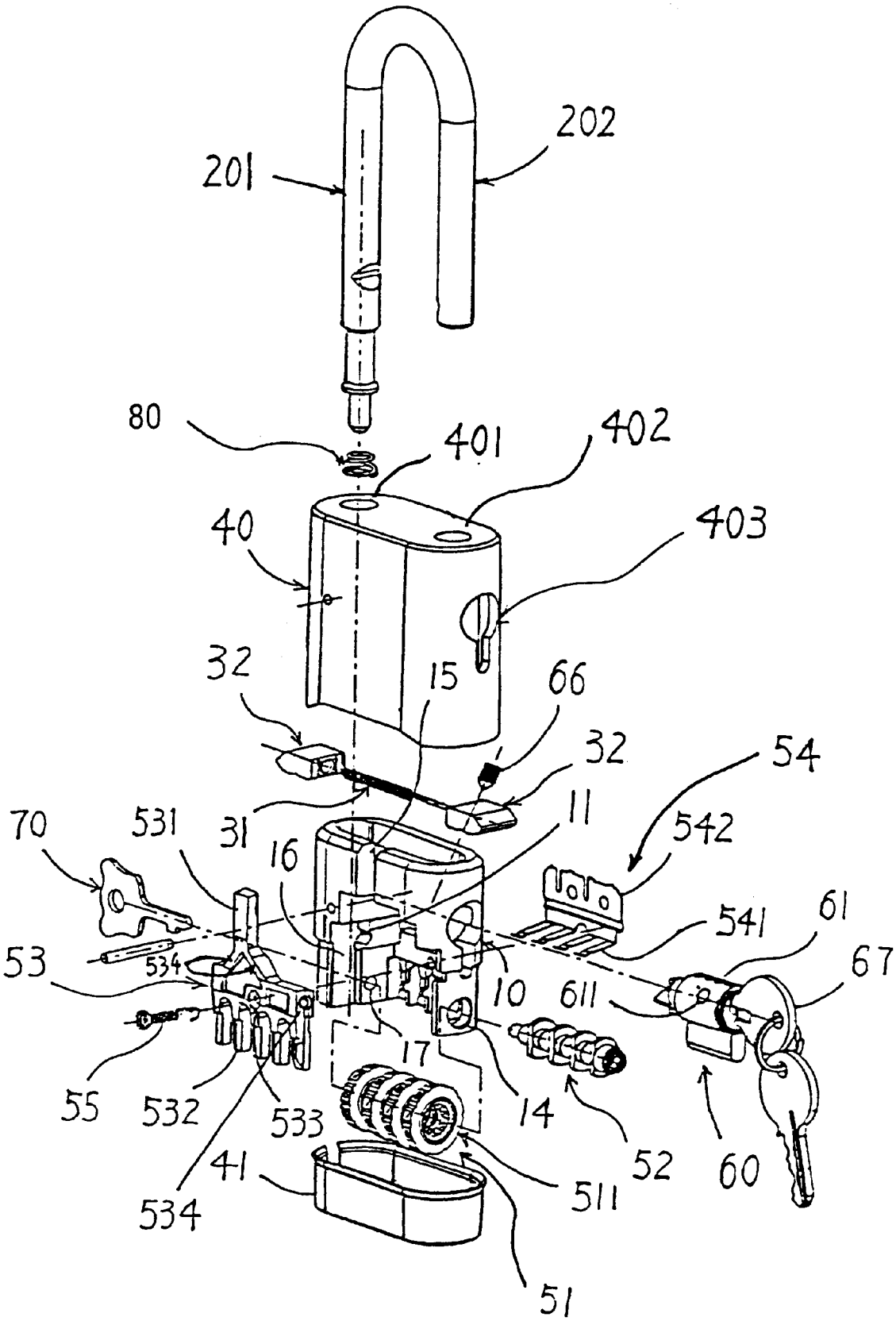
FIG. 2 shows an exploded view of the padlock as shown in FIG. 1.

Referring to FIG. 1 and FIG. 2, the lock bolt mechanism 30 is disposed on a platform (not shown) at the upper portion of the body. The lock bolt mechanism 30 includes a spring 31 and two blocks 32 connected to the two ends of the spring 31. The lock cylinder assembly 60 is disposed at the middle portion in the lock body 10 through a hole 403 at the housing and a hole 13 at the lock body 10.

Figure 4:
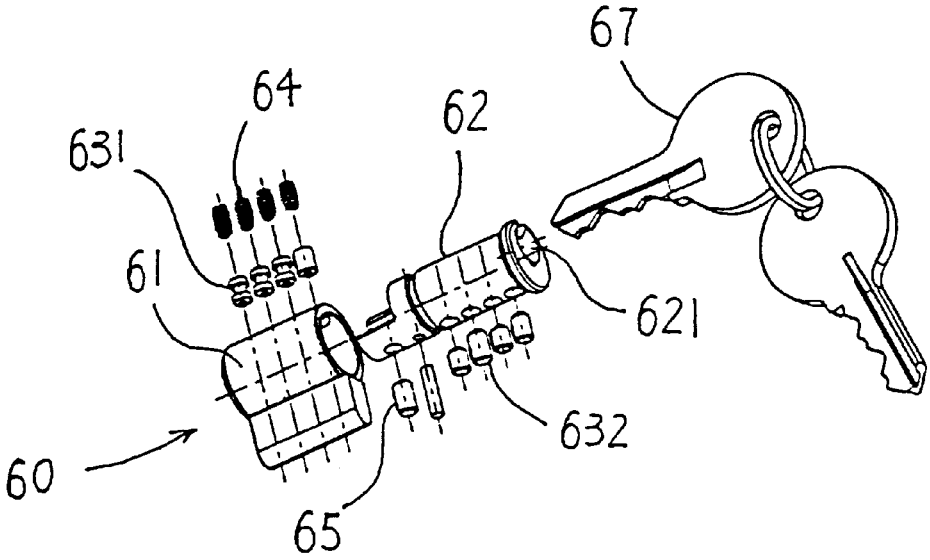
FIG. 4 is an exploded view of an embodiment of the lock cylinder assembly of the invention.

The lock body assembly 60, referring to FIG. 4, comprises a cylinder housing 61, a lock cylinder 62 disposed through the cylinder housing 61, and a key receiving recess 621 extended axially and inwardly for receiving a first key 67. In FIG. 4, reference numerals 631 and 632 represent slide pins, and reference numeral 64 is a spring. This configuration is similar to that in the prior art. However, in the invention, a drive pin 65 is connected to the portion of the lock cylinder 62 that is out of the cylinder housing 61.

Figure 3:
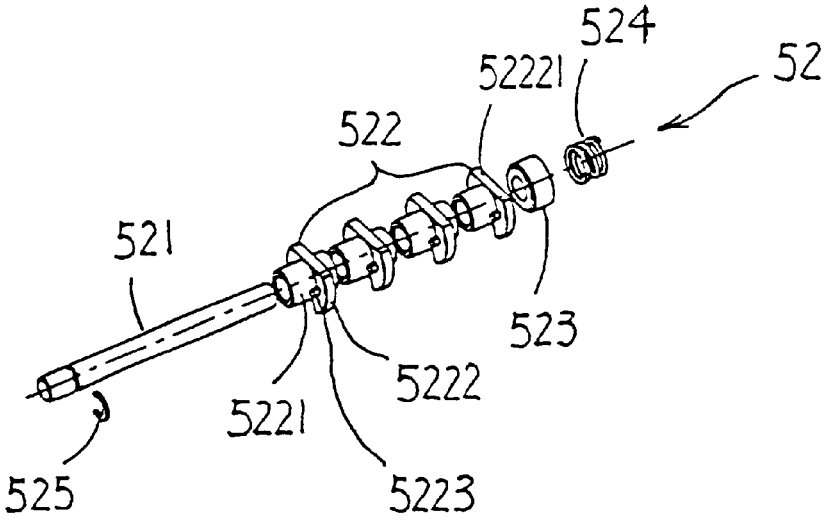
FIG. 3 is an exploded view of an embodiment of the clutch mechanism of the invention.

Again referring to FIG. 1 and FIG. 2, the combination lock assembly 50 comprises a fork mechanism 53 having a fork lever 531, two fork arms 534 extended from the fork lever and four plates 532 connected to the fork arms and parallel to the fork lever 531; a wheel mechanism 51 comprising four numeral wheels 511, each numeral wheel 511 being disposed between two adjacent plates; and a clutch mechanism 52 disposed within the wheel mechanism 51. The fork mechanism 53 is connected with the second sidewall by a fastening spring 55 via a spring hole 533 at the middle portion of the fork mechanism 53. The fork lever can move outwards and inwards within the opening 15 with respect to the first sidewall. A part of the fork lever is positioned between the two blocks. As shown in FIG. 3, the clutch mechanism 52 includes a clutch shaft 521 and four rotatable clutch sleeves 522 disposed on the clutch shaft 521. Each clutch sleeve 522 has a canula 5221 and a disc 5222 housed on the canula 5221 and perpendicular to the clutch shaft 521. All the discs have a plane 52221 in matching with the plate 532. A positioning ring 525 is mounted to one end of the clutch shaft 521, and a spring holder 523 holding a spring 524 is connected to the other end of the clutch shaft 521.

As shown in FIG. 3, a project 5223 is provided at each canula 5221 to engage a recess provided at the inner wall of the numeral wheel (not shown). The numeral wheel is arranged on the canula 5221 of the clutch sleeve 522 by the engagement of project 5223 and the recess at the inner wall of the numeral wheel. The clutch mechanism 52 is mounted into the body 10 through a hole 14 at the lower portion of the body, as shown in FIG. 2. The disc 5222 of the clutch sleeve contacts the plate 532.

In FIG. 2, the combination lock mechanism may further comprise a reed mechanism 54. The reed mechanism includes a connecting member 542 fixed to the second sidewall of the lock body 10, and four reeds 541 perpendicular to the connecting member 542. Each reed presses the upper rim of the numeral wheel 511. There are Arabic numbers from 0 to 9 at the outer rim of the numeral wheel 511. Turning the numeral wheel 511 can drive the disc 5222 to rotate correspondingly. With the reed's action, the numeral wheel can be turned only one number once.

Referring to FIG. 2, two protrusions 11 are provided in the body 10 to engage two recesses 534 (only showing one) provided by the fork mechanism at its outside correspondingly so that the fork mechanism can rotate round the two protrusions 11.

Figure 5:
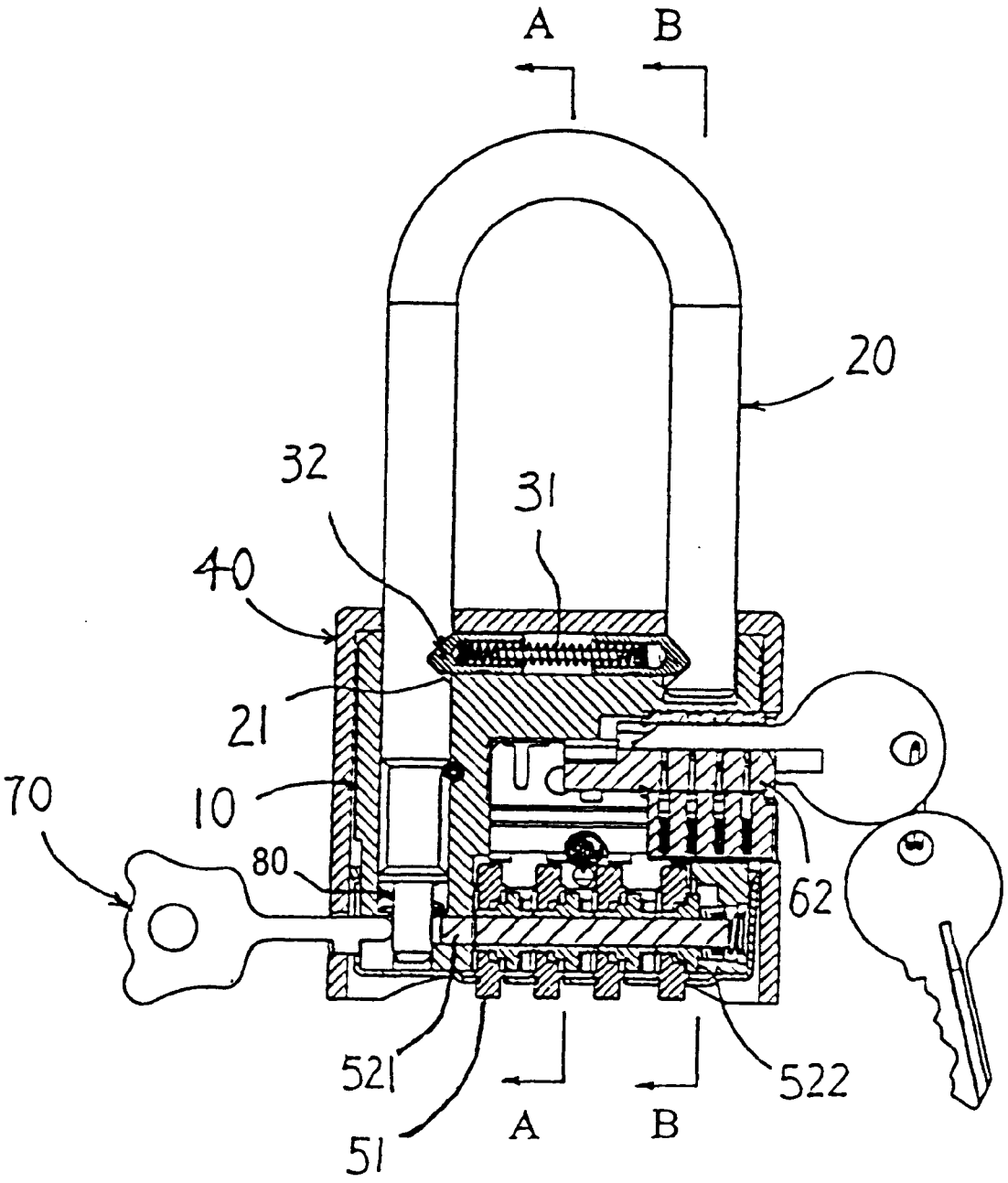
FIG. 5 is a sectional view of an embodiment of the padlock of the invention.
Figure 6:
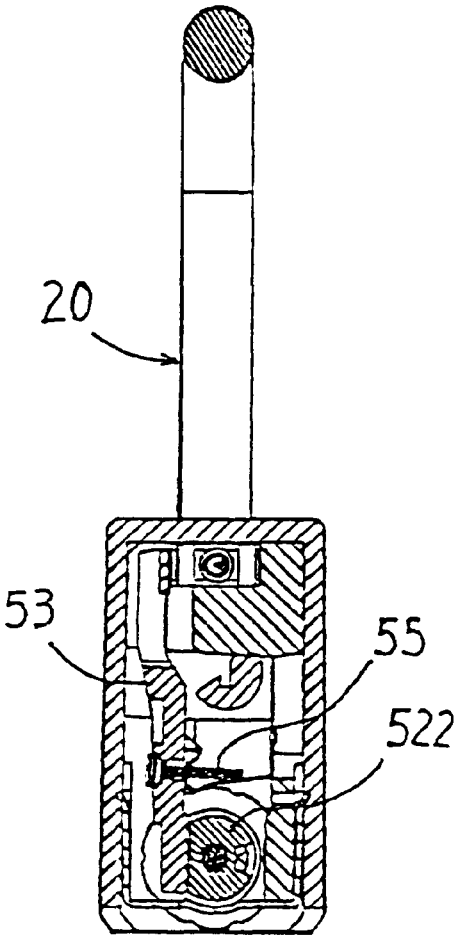
FIG. 6 is the sectional view taken along the line A—A in FIG. 5.

Now referring to FIGS. 1, 5, and 6, when the padlock of the invention is locked, the two blocks 32 are engaged with two shackle recesses 21. Because a part of the fork lever 531 is positioned between the two blocks, the blocks 32 are barred from removing out of the shackle recesses. When the lock cylinder 62 is driven to turn by the first key, the drive pin 65 pushes the fork lever 531 to move outwards. In this case, the two blocks move to the center of the spring 31 by pressing the shackle 20 downwards, the padlock is unlocked under the action of a drive spring 80 disposed at the bottom of the first shackle groove 101 for acting on the long leg 201 of the shackle 20. When the numeral wheels 511 are turned to a predetermined sequence, all the planes 52221 of the discs 5222 are positioned at the same plane as shown in FIG. 6 and contacts the inner surface of the plates 532. The fork mechanism 53 rotates round the protrusions by the action of the fastening spring 55 and the fork lever 531 moves outwards. In this case, the two blocks move to the center of the spring 31 by pressing the shackle downwards. The padlock is unlocked under the action of the drive spring 80.

The padlock of the invention also provides a means for resetting the cipher. The means includes a second key 70 that can be inserted into the lock body 10 through a second key receiving recess 17 in the lock body 10, as shown in FIG. 2. The second key receiving recess 17 is positioned to face the clutch shaft 521. When the padlock is unlocked, the second key can drive the clutch shaft 521 to move backwards so that the discs 522 are separated from the plates 532. A new cipher can be set by turning the numeral wheels to a new sequence and taking out the second key.

Figure 7:
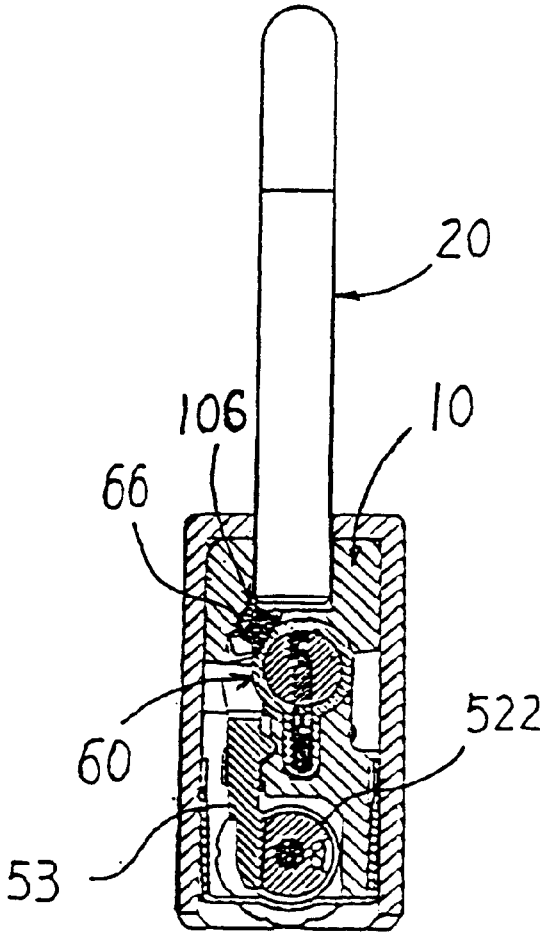
FIG. 7 is the sectional view taken along the line B—B in FIG. 5.

The lock cylinder assembly 60 of the invention can be replaceable, as shown in FIG. 2 and FIG. 7. The lock cylinder assembly 60 is inserted into the body 10 through the hole 403 at the housing 40 and the hole 13 at the body 10. The holes 403 and 13 are matched with the configuration of the lock cylinder assembly. Within the body 10, an oblique screw hole 106 extended downwards from the shackle recess 21 is provided. The oblique screw hole 106 is extended to reach a connecting groove 611 at the surface of the lock housing 61 so that a screw 66 can be screwed into the screw hole 106 and the connecting groove 611 to fasten the lock cylinder assembly 60 to the lock body 10. When necessary, the lock cylinder assembly can be replaced by drawing the screw 66 out of the receiving groove 611.

Although the invention is illustrated by the above embodiments and descriptions, it is understood that any varieties and modifications to the invention without departure from the spirit of the invention will fall within the scope of appended claims.

What is claimed is:

1. A padlock comprising:

a shackle having a long leg, a short leg, and two bolt recesses disposed at said long leg and said short leg respectively;

a housing having two shackle holes at the upper portion to allow said shackle passing therethrough;

a lock body having a first sidewall, a second sidewall, and a first shackle groove for receiving said long leg of said lock shackle, and a second shackle groove for receiving said short leg of said lock shackle;

a lock bolt mechanism disposed in said lock body, including a spring and two blocks connected to the two ends of said spring;

a lock cylinder assembly disposed at the middle portion in said lock body, comprising a cylinder housing, a lock cylinder disposed through said cylinder housing, a key receiving recess extended axially and inwardly for receiving a first key, and a drive pin connected to the portion of said lock cylinder out of said cylinder housing; and a combination lock assembly comprising a fork mechanism having a fork lever and a plurality of plates parallel to said fork lever, connected with said second sidewall by a fastening spring; a wheel mechanism comprising a plurality of numeral wheels, each numeral wheel being disposed between two adjacent plates; a clutch mechanism disposed within said wheel mechanism, including a clutch shaft and a plurality of rotatable clutch sleeves disposed on said clutch shaft, each clutch sleeve including a disc perpendicular to said clutch shaft, said disc having a plane at its rim in matching with said plate, wherein when the padlock is locked, said two blocks of said lock bolt mechanism are engaged with said bolt recesses of said shackle and said fork lever is positioned between said two blocks, wherein when said first key inserted into said first key receiving recess is turned, said drive pin drives said fork lever to move outwards so that said two blocks move to the center of said spring by pressing said shackle downwards to unlock the padlock, wherein when said numeral wheels are turned to a predetermined sequence, all said planes of said discs are positioned at the same plane and contact said plates of said fork mechanism, said fork lever moves outwards by the action of said fastening spring so that said two blocks can move to the center of said spring by pressing said shackle downwards to unlock the padlock.

2. A padlock according to claim 1 further comprising a drive spring disposed at the bottom of said first shackle groove for acting on said long leg of said shackle.

3. A padlock according to claim 1, wherein said lock body defines two protrusions extended longitudinally for matching two recesses at the outside of said fork mechanism so that said fork mechanism can rotate round said protrusions to ensure said fork lever to move outwards.

4. A padlock according to claim 2, wherein said lock body defines two protrusions extended longitudinally for matching two recesses at the outside of said fork mechanism so that said fork mechanism can rotate round said protrusions to ensure said fork lever to move outwards.

5. A padlock according to claim 1 further including a means for resetting a new cipher, wherein said means comprises a second key that can drive said clutch shaft moving backwards so that said new cipher can be set by turning said numeral wheels.

6. A padlock according to claim 2 further including a means for resetting a new cipher, wherein said means comprises a second key that can drive said clutch shaft moving backwards so that said new cipher can be set by turning said numeral wheels.

7. A padlock according to claim 3 further including a means for resetting a new cipher, wherein said means comprises a second key that can drive said clutch shaft moving backwards so that said new cipher can be set by turning said numeral wheels.

8. A padlock according to claim 1, wherein said lock body provides an oblique screw hole extended from said second shackle groove to reach a connecting groove positioned at the surface of said cylinder housing so that a screw can be screwed into said oblique screw hole and said connecting groove for fastening said lock cylinder assembly.

9. A padlock according to claim 2, wherein said lock body provides an oblique screw hole extended from said second shackle groove to reach a connecting groove positioned at the surface of said cylinder housing so that a screw can be screwed into said oblique screw hole and said connecting groove for fastening said lock cylinder assembly.

10. A padlock according to claim 3, wherein said lock body provides an oblique screw hole extended from said second shackle groove to reach a connecting groove positioned at the surface of said cylinder housing so that a screw can be screwed into said oblique screw hole and said connecting groove for fastening said lock cylinder assembly.

11. A padlock according to claim 4, wherein said lock body provides an oblique screw groove extended from said second shackle groove to reach a connecting groove positioned at the surface of said cylinder housing so that a screw can be screwed into said oblique screw hole and said connecting groove for fastening said lock cylinder assembly.

12. A padlock according to claim 5, wherein said lock body provides an oblique screw groove extended from said second shackle groove to reach a connecting groove positioned at the surface of said cylinder housing so that a screw can be screwed into said oblique screw hole and said connecting groove for fastening said lock cylinder assembly.

13. A padlock according to claim 6, wherein said lock body provides an oblique screw groove extended from said second shackle groove to reach a connecting groove positioned at the surface of said cylinder housing so that a screw can be screwed into said oblique screw hole and said connecting groove for fastening said lock cylinder assembly.

14. A padlock according to claim 7, wherein said lock body provides an oblique screw groove extended from said second shackle groove to reach a connecting groove positioned at the surface of said cylinder housing so that a screw can be screwed into said oblique screw hole and said connecting groove for fastening said lock cylinder assembly.

15. A padlock according to claim 1, wherein said combination lock assembly further comprises a reed mechanism including a connecting member fastened to said second sidewall and a plurality of reeds perpendicular to said connecting member, each reed contacting the upper rim of a numeral wheel so that said numeral wheel can only turn one number once.

16. A padlock according to claim 2, wherein said combination lock assembly further comprises a reed mechanism including a connecting member fastened to said second sidewall and a plurality of reeds perpendicular to said connecting member, each reed contacting the upper rim of a numeral wheel so that said numeral wheel can only turn one number once.

17. A padlock according to claim 3, wherein said combination lock assembly further comprises a reed mechanism including a connecting member fastened to said second sidewall and a plurality of reeds perpendicular to said connecting member, each reed contacting the upper rim of a numeral wheel so that said numeral wheel can only turn one number once.

18. A padlock according to claim 4, wherein said padlock further comprises a bottom cover to match said housing, wherein the outer rim of said numeral wheel exceeds said bottom cover.

19. A padlock according to claim 4, wherein said lock cylinder assembly comprises a plurality of slide pins mounted at said lock cylinder and said cylinder housing.

20. A padlock according to claim 4, wherein said clutch mechanism further comprises a fixing member connected to one end of said clutch shaft, and a spring holder holding a fixing spring connected at the other end of the clutch shaft.

* * * * *